US010428532B2

(12) United States Patent
Smart

(10) Patent No.: US 10,428,532 B2
(45) Date of Patent: Oct. 1, 2019

(54) CLADDING CLIP

(71) Applicant: Hugh Thomas Smart, London (GB)

(72) Inventor: Hugh Thomas Smart, London (GB)

( * ) Notice: Subject to any disclaimer, the term of this patent is extended or adjusted under 35 U.S.C. 154(b) by 0 days.

(21) Appl. No.: 15/773,914

(22) PCT Filed: Nov. 4, 2016

(86) PCT No.: PCT/GB2016/053453

§ 371 (c)(1),
(2) Date: May 4, 2018

(87) PCT Pub. No.: WO2017/077328

PCT Pub. Date: May 11, 2017

(65) Prior Publication Data

US 2018/0334809 A1 Nov. 22, 2018

(30) Foreign Application Priority Data

Nov. 6, 2015 (GB) ..... 1519670.2

(51) Int. Cl.
*E04F 13/08* (2006.01)

(52) U.S. Cl.
CPC ..... *E04F 13/0846* (2013.01); *E04F 13/0826* (2013.01); *E04F 13/0894* (2013.01); *E04F 13/0862* (2013.01); *E04F 2201/0517* (2013.01)

(58) Field of Classification Search
CPC ..... E04F 13/0846; E04F 2201/0517; E04F 13/0826; E04F 13/0894; E04F 13/0862
See application file for complete search history.

(56) References Cited

U.S. PATENT DOCUMENTS 2,668,342 A * 2/1954 Nelsson ..... F16B 2/248 24/561
2,831,222 A * 4/1958 Anderson ..... E04F 13/0826 52/489.1
3,300,924 A * 1/1967 Ashby ..... E04F 13/0812 52/265
3,412,515 A * 11/1968 Finon ..... E04F 13/0801 52/480
3,412,516 A * 11/1968 Lindstrom ..... E04B 9/363 52/222
4,439,970 A * 4/1984 Rosner ..... E04F 13/0816 411/461

(Continued)

FOREIGN PATENT DOCUMENTS

AT 515684 T * 7/2011 ..... G01D 5/268
CH 700410 A2 8/2010

(Continued)

OTHER PUBLICATIONS

International Search Report and Written Opinion for International Application No. PCT/GB2016/053453, completed Jan. 12, 2017, 16 pages.

(Continued)

*Primary Examiner* — Rodney Mintz
(74) *Attorney, Agent, or Firm* — Barnes & Thornburg LLP

(57) ABSTRACT

A cladding clip comprising a lateral base, a head coupled to the lateral base, and a flexible lip upstanding from the lateral base and laterally spaced from the neck along the base is disclosed. The flexible lip is hooked so that a lateral part of the lip extends laterally spaced from the base.

19 Claims, 7 Drawing Sheets

(56) References Cited

U.S. PATENT DOCUMENTS

| | | | | | |
|---|---|---|---|---|---|
| 5,245,811 | A * | 9/1993 | Knorr | E04B 2/7409 403/382 |
| 5,390,462 | A * | 2/1995 | Kreiter | A47F 5/0846 211/189 |
| 6,421,974 | B1 * | 7/2002 | Whitehouse | E04F 13/0864 52/384 |
| 7,010,894 | B1 * | 3/2006 | Cappelle | E04B 9/26 52/384 |
| 8,850,772 | B1 * | 10/2014 | Stanfill | E04D 3/362 52/520 |
| 9,657,481 | B2 * | 5/2017 | Florenske | E04F 13/0812 |
| 2003/0009973 | A1 | 1/2003 | Lee | |
| 2005/0204677 | A1 | 9/2005 | Mei | |
| 2011/0016815 | A1 * | 1/2011 | Yang | E04F 15/02 52/396.04 |
| 2014/0260056 | A1 * | 9/2014 | Stanfill | E04D 3/362 52/588.1 |
| 2015/0337538 | A1 * | 11/2015 | Florenske | E04D 3/362 52/520 |
| 2016/0102462 | A1 * | 4/2016 | Griffiths | E04F 13/083 52/550 |

FOREIGN PATENT DOCUMENTS

| | | | | |
|---|---|---|---|---|
| DE | 2254210 | A1 | 5/1974 | |
| EP | 1120515 | A1 | 8/2001 | |
| EP | 2706165 | A1 | 3/2014 | |
| GB | 2155970 | A | 12/1984 | |
| GB | 2331770 | A | 11/1998 | |
| GB | 2371609 | A * | 7/2002 | E04B 5/12 |
| JP | 2005155119 | A | 6/2005 | |
| WO | 0138668 | A1 | 5/2001 | |
| WO | 03102328 | A1 | 12/2003 | |

OTHER PUBLICATIONS

Intellectual Property Office Search Report for Application No. GB1519670.2, dated May 17, 2016, 4 pages.

Intellectual Property Office Error in Search Report for Application No. GB1519670.2, dated Oct. 21, 2016, 2 pages.

Intellectual Property Office Examination Report for Application No. GB1519670.2, dated Oct. 21, 2016, 2 pages.

Intellectual Property Office Examination Report for Application No. GB1519670.2, dated May 30, 2017, 4 pages.

Intellectual Property Office Examination Report for Application No. GB1519670.2, dated Aug. 30, 2017, 4 pages.

Intellectual Property Office Search Report for Application No. GB1519670.2, dated May 30, 2017, 2 pages.

Intellectual Property Office Examination Report for Application No. GB1519670.2, dated Dec. 19, 2017, 4 pages.

Intellectual Property Office Combined Search and Examination Report for Application No. GB1519670.2, dated Aug. 30, 2017, 4 pages.

* cited by examiner

CLADDING CLIP

FIELD OF THE INVENTION

The present disclosure relates to a clip, for example a cladding clip for fixing cladding boards to surfaces such as walls or ceilings.

BACKGROUND

Cladding clips are commonly used to clip cladding boards to a surface such as a wall or ceiling. Cladding clips allow cladding boards to be quickly and easily fixed in position for aesthetic or functional purposes.

Many conventional cladding clips are designed for use with composite cladding boards. In such conventional systems, the composite cladding boards are designed to have certain thermal and hygroscopic characteristics, for example they are designed to be water repellent and to have limited thermal expansion.

SUMMARY OF THE INVENTION

Aspects of the invention are as set out in the independent claims and optional features are set out in the dependent claims. Aspects of the invention may be provided in conjunction with each other and features of one aspect may be applied to other aspects.

DRAWINGS

Embodiments of the disclosure will now be described, by way of example only, with reference to the accompanying drawings, in which.

Figure 1:
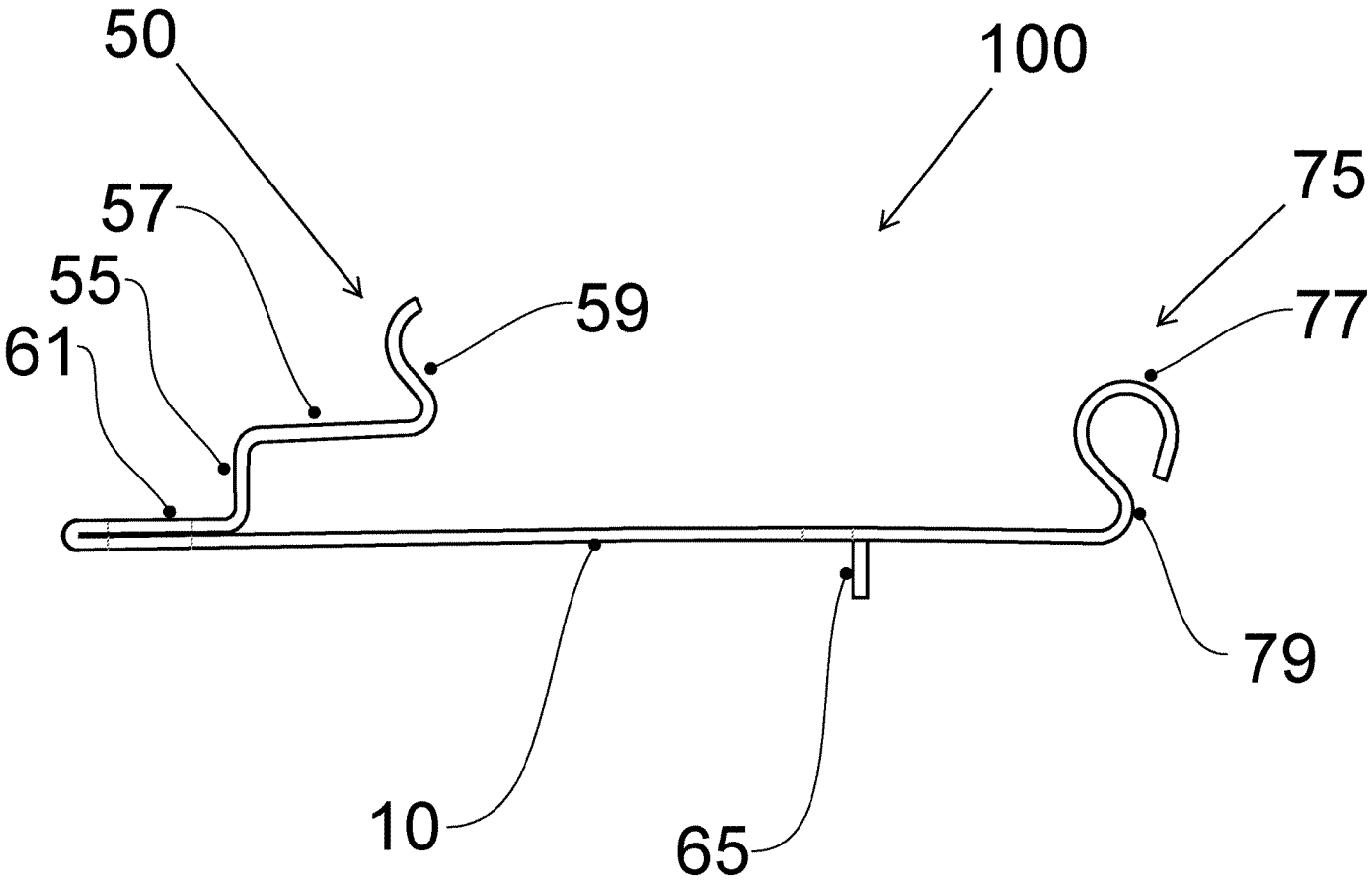
FIG. 1 shows a cross-section of a cladding clip.
Figure 5A:
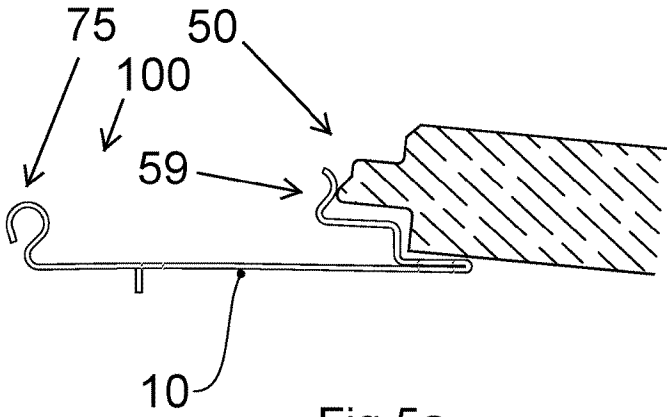
Figure 5B:
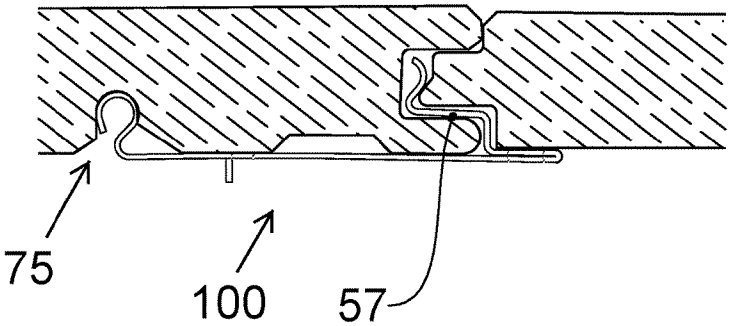
Figure 6:
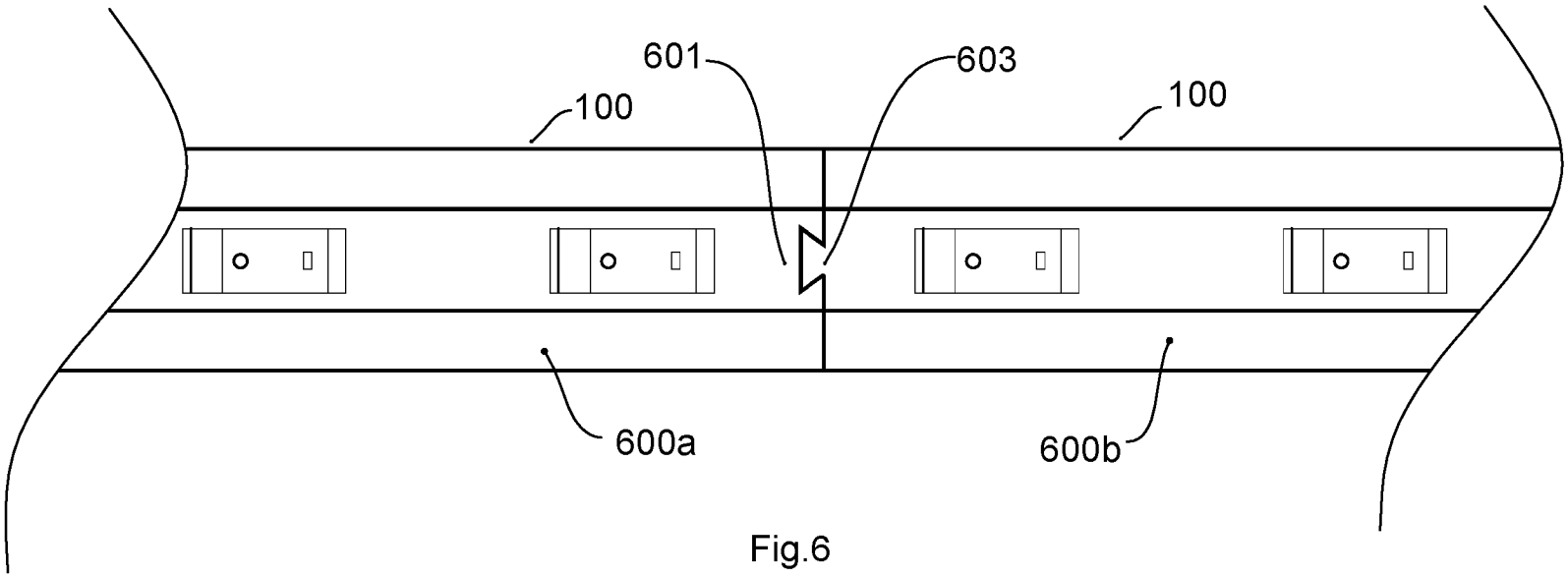
Figure 7:
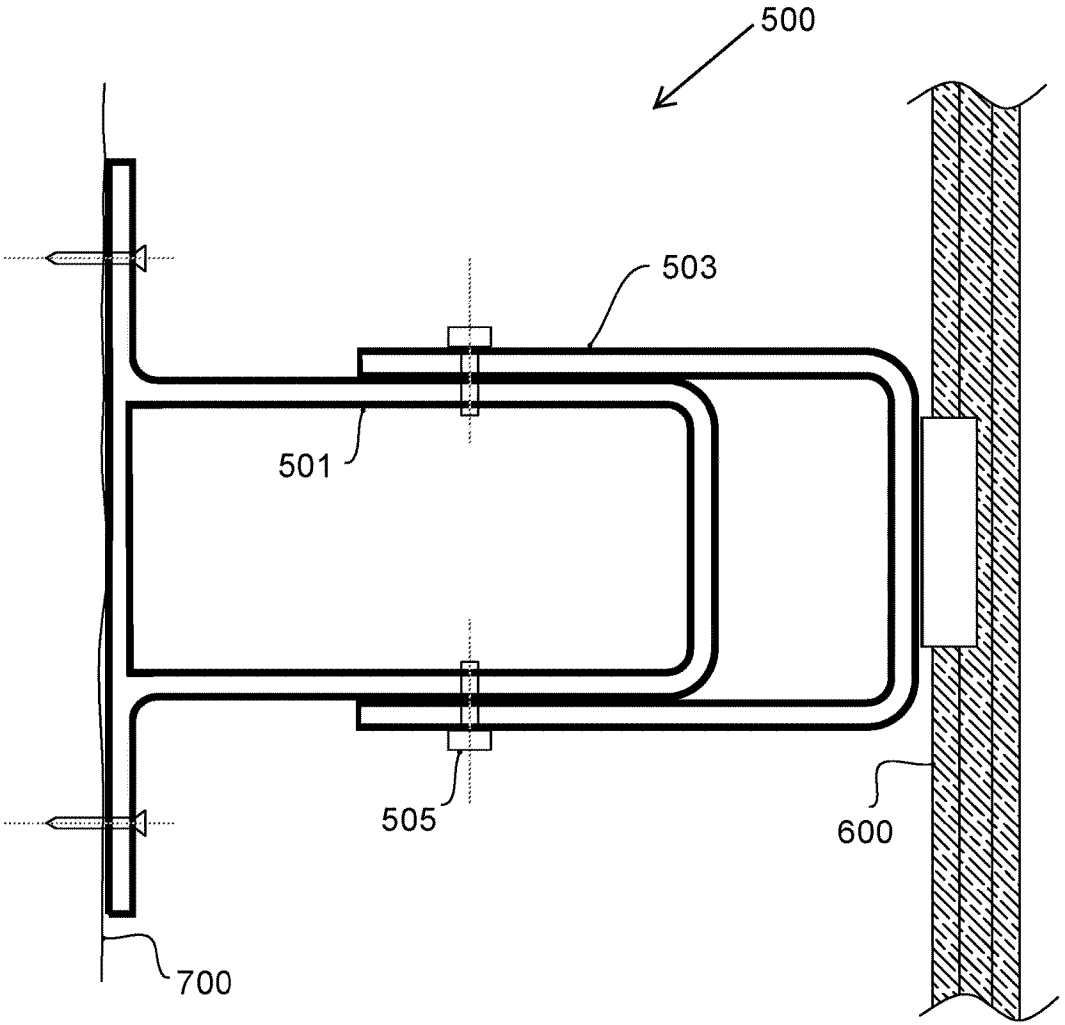

FIG. 5*a* shows a cladding board engaged with a portion of a cladding clip such as that illustrated in FIG. 1;

FIG. 5*b* shows two cladding boards engaged with a cladding clip such as that illustrated in FIG. 1;

FIG. 6 shows a plan view of two battens mated together and each carrying a corresponding cladding clip such as that illustrated in FIG. 1; and FIG. 7 shows a cross-section of an adjustable offset member for accommodating irregularities in the surface of a wall or ceiling.

SPECIFIC DESCRIPTION

Embodiments of the claims relate to a cladding clip, for example for cladding a structure with cladding boards. As shown in FIG. 1, the cladding clip 100 is generally flat with two portions upstanding at either end of the clip for interacting with a cladding board. The upstanding portions may hold the cladding board in place and accommodate movement of the cladding boards, for example due to hygroscopic or thermal expansion, so that a series of cladding boards supported by a series of cladding clips spaced at repeating intervals appear evenly spaced.

Figure 3:
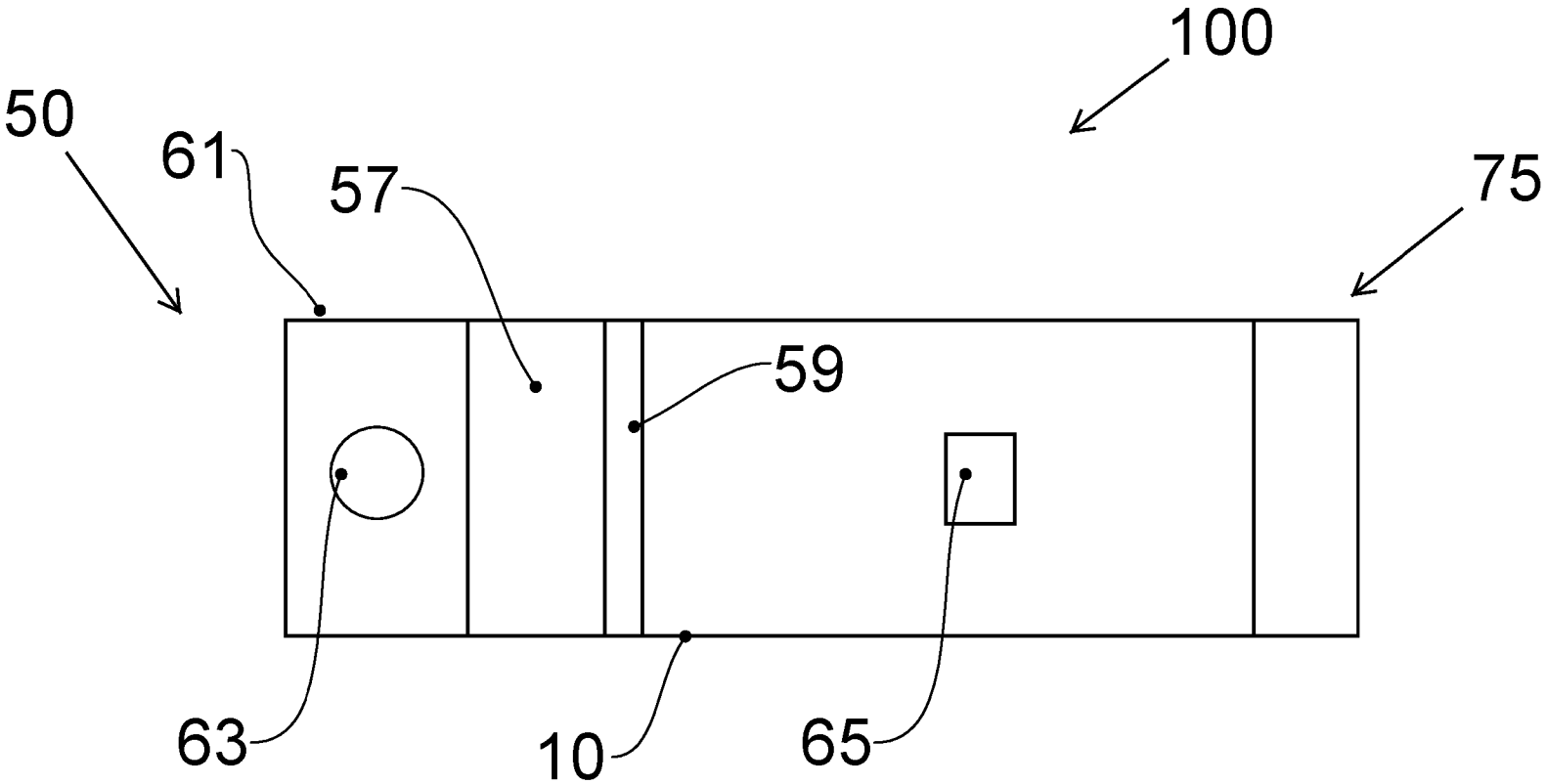
FIG. 3 shows a plan view of the cladding clip of FIG. 1.

As shown in FIGS. 1 and 3, the cladding clip 100 has a flexible lip 50 for receiving an end of a cladding board, and a head 75. Both the head 75 and the flexible lip 50 are coupled to a generally flat, lateral base 10 of the clip 100 which extends laterally between the two. The cladding boards illustrated in FIGS. 4, 5*a* and 5*b* for use with the cladding clip 100 of FIG. 1 are tongue and groove type boards, and have an additional groove on the near surface for receiving the head 75.

Figure 2:
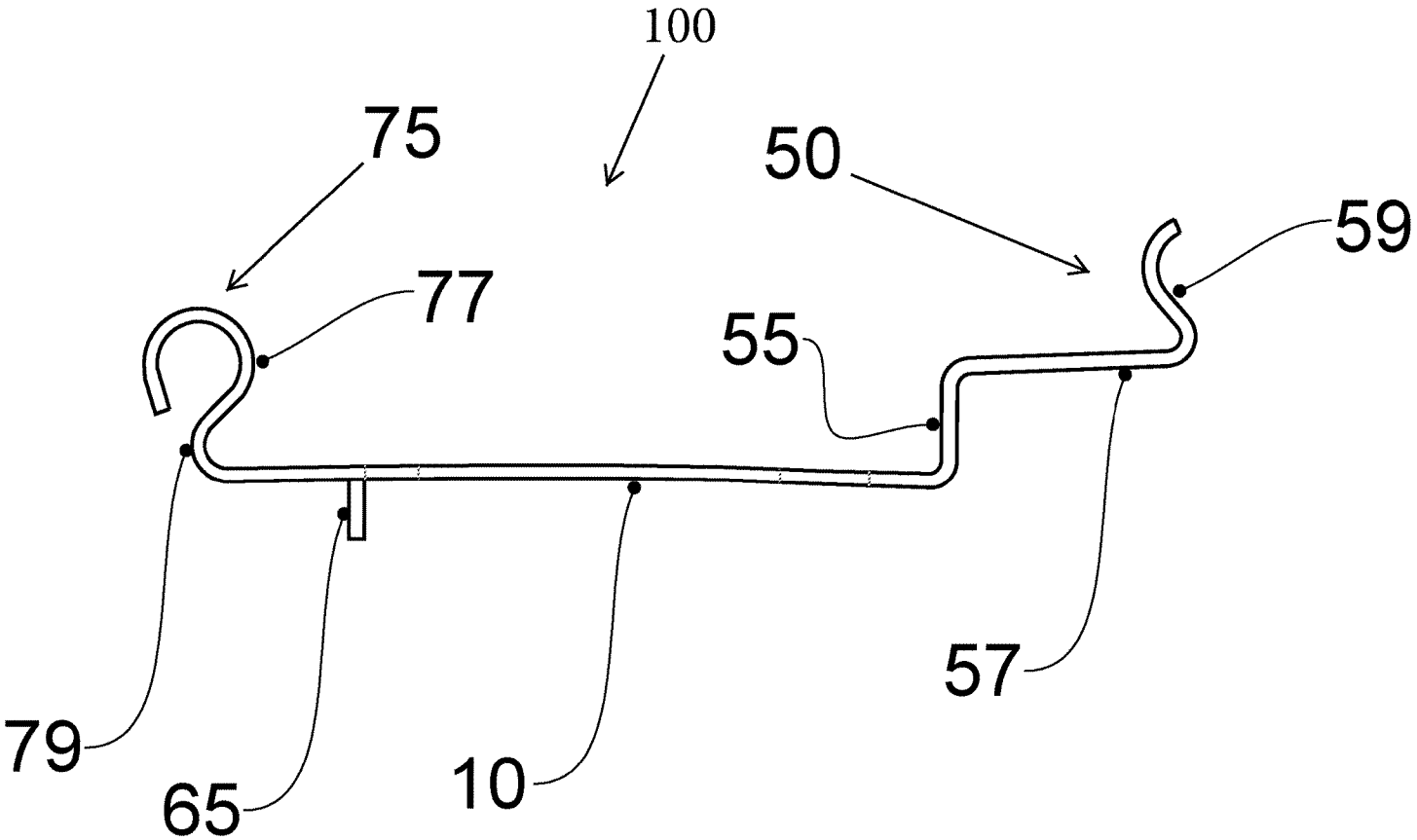
FIG. 2 shows a cross-section of another cladding clip.

Also as shown in FIGS. 1 and 3, the head 75 comprises a resilient loop 77 coupled to the lateral base 10 by a resilient neck 79 upstanding from the lateral base 10. The flexible lip 50 may be hooked so that a lateral part 57 of the flexible lip 50 extends laterally, spaced from the base 10. In the example shown in FIGS. 1 and 3, the lateral part 57 extends laterally back toward the head 75. In other examples, for example as shown in FIG. 2, the lateral part 57 of the flexible lip 50 extends laterally away from the head 75.

The head 75 is configured to engage with a corresponding groove in the near surface of the cladding board to locate the cladding board at a selected lateral position with respect to the flexible lip 50. The flexible lip 50 is configured to receive and hold a portion of a cladding board between, on the one hand, a portion of the lip 50, for example the lateral part 57, and on the other hand, the lateral base 10 and/or a surface the board is fixed to.

The flexible lip 50 may comprise a first upstanding part 55 which spaces the lateral part 57 of the flexible lip 50 from the base 10 by a vertical stand-off distance. The flexible lip 50 may also comprise a second upstanding part 59 upstanding from the lateral part 57. The lateral part 57 and the second upstanding part 59 may be shaped to mate with a tongue and groove joint of cladding boards to hold the cladding boards in place. The lateral part 57, and in some examples the second upstanding part 59, of the flexible lip 50 may be configured to extend between a tongue and groove of a tongue and groove joint of cladding boards. For example, the flexible lip 50 may be configured to partially surround a tongue of a tongue and groove joint of cladding boards whilst fitting within the groove, for example the flexible lip 50 interleaves between the tongue and the groove when the cladding boards are assembled.

By fastening cladding boards to a structure using the cladding clips 100, so that the flexible lip 50 of each cladding clip 100 interleaves a tongue and groove joint between two cladding boards, a series of cladding boards may be fixed to the structure using a series of cladding clips spaced at selected intervals corresponding to a dimension of the cladding boards.

The clips shown in the FIGS. 1, 2 and 3 will now be described in more detail. FIGS. 1 and 3 shows a cladding clip 100 comprising a lateral base 10, which in FIGS. 1, 2 and 3 is flat. A head 75 is coupled to and upstanding from the lateral base 10. A flexible lip 50 is upstanding from the lateral base 10, laterally spaced from the head 75 along the base 10. The head 75 and flexible lip 50 are upstanding from the same side of the lateral base 10. The flexible lip 50 is hooked so that a lateral part 57 of the lip 50 is spaced from the base 10 and extends back towards the head 75. The lateral part 57 of the lip 50 shown in FIG. 1 is 9.8 mm long. The lateral base is 56 mm long and 16 mm wide. Other dimensions may be suitable, and the lateral part 57 of the lip 50 may be between 5 and 15 mm long, for example between 8 and 12 mm long. The lateral base may be between 2 and 10 mm long, for example between 4 and 7 mm, and between 10 and 30 mm wide, for example between 10 and 20 mm wide.

FIG. 2 shows a cladding clip 100 similar to the cladding clip of FIG. 1, except in the example shown in FIG. 2, the lateral part 57 of the lip 50 extends laterally away from the head 75.

In the examples shown in FIGS. 1 and 2, the flexible lip 50 comprises a first upstanding part 55 which spaces the lateral part 57 of the flexible lip 50 from the lateral base 10, and a second upstanding part 59 upstanding from the lateral part 57 of the flexible lip 50. The second upstanding part 59 is upstanding from the lateral part 57 on an opposing end and an opposing side of the lateral part 57 to the first upstanding part 55. The first upstanding part 55 in FIG. 1 is 6.75 mm long, and the second upstanding part 59 in FIG. 1 is 7.13 mm long so that the top of the second upstanding part 59 is 13.88 mm from the lateral base 10. In FIG. 2 the second upstanding part 59 is 7.5 mm long and its top is 13.25 mm from the lateral base 10. Other dimensions for the cladding clip 100 may be suitable. For example, the second upstanding part 59 may be between 5 and 10 mm long, for example between 7 and 8 mm long. The first upstanding part 55 may be between 5 and 15 mm long, for example between 6 and 8 mm long.

The second upstanding part 59 of the flexible lip 50 is hooked. In the example cladding clips 100 shown in FIGS. 1 and 2, the hook is provided by a curve or belly facing towards the lateral part 57 of the flexible lip 50, but the hook may be provided in other ways, for example by providing an "L" or "T" shape. In the example shown in FIG. 1, the hook in the second upstanding part 59 takes the form of an "S" shape of radius 1.78 mm. The belly or curve in the second upstanding part 59 in FIG. 1 extends, at its apex, 2.4 mm away from a plane normal to the lateral part 57 and away from the head 75. Other dimensions may be suitable.

In the example shown in FIG. 2 the lateral part 57 is straight. In the example shown in FIG. 1 the lateral part 57 has a curve or belly facing towards the lateral base 10. The curve or belly of the lateral part 57 takes the form of a partial circle of radius 15 mm. Again, other dimensions may be suitable.

In the examples shown in FIGS. 1, 2 and 3, the head 75 comprises a resilient loop 77 coupled to the lateral base 10 by a resilient neck 79 upstanding from the lateral base 10. The resilient loop 77 does not form a complete circle and is open ended so that an end of the circle is not coupled to the start of the circle. The width of the resilient loop 77 (and therefore of the head 75) is 5.1 mm in the example shown in FIG. 1 and 5.4 mm in the example shown in FIG. 2, and the top of the resilient loop 77 is 8.25 mm from the lateral base 10 in both FIGS. 1 and 2. The lateral separation between the first upstanding part 55 of the flexible lip 50 and the head 75 is 40.4 mm along the lateral base 10 in FIG. 1 and 35.7 mm in FIG. 2. Other dimensions may be suitable. For example the lateral separation between the first upstanding part 55 and the head 75 may be between 20 and 50 mm, for example between 30 and 45 mm. The width of the head 75 may be between 30 and 70 mm, for example between 40 and 60 mm. The height of the top of the head 75 from the lateral base 10 may be between 5 and 20 mm, for example between 6 and 12 mm.

The cladding clips 100 shown in FIGS. 1, 2 and 3 are pressed from a sheet of resilient material, for example spring steel. Each of the parts of the flexible lip 50, such as the first upstanding part 55, the lateral part 57 and the second upstanding part 59, are formed by bending the material making up the cladding clip 100, for example by folding the resilient material onto itself.

Figure 4:
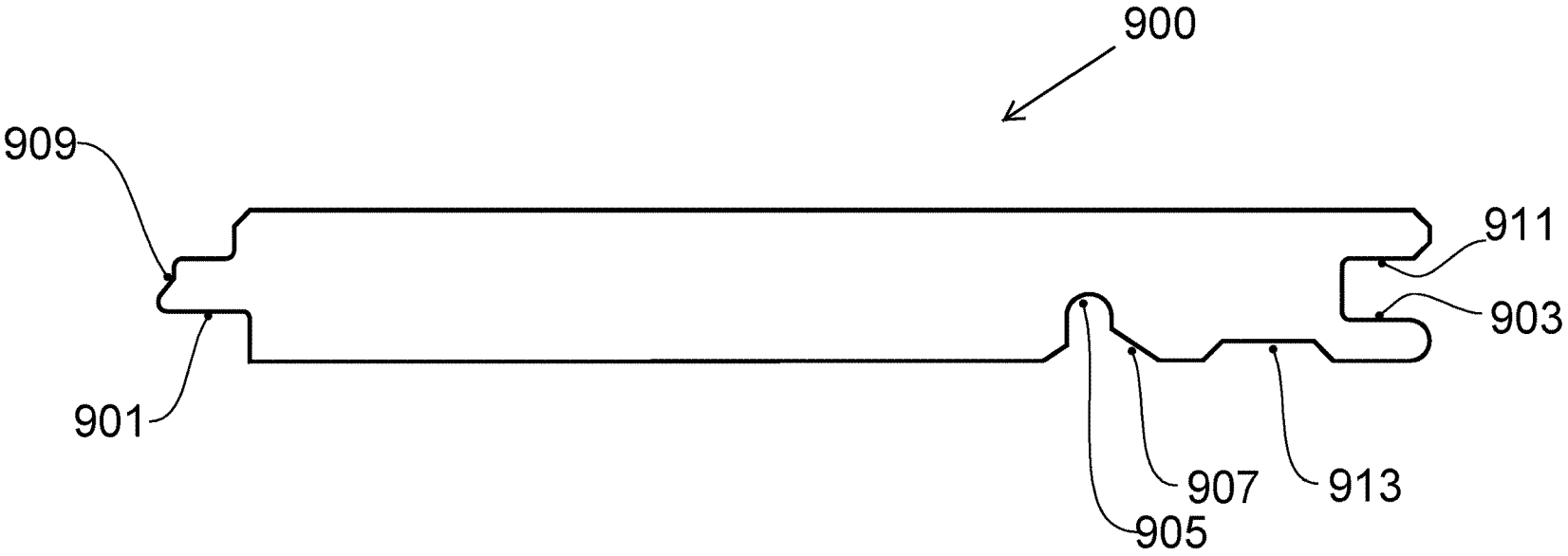
FIG. 4 shows a cross-section of a cladding board for use with a cladding clip such as that illustrated in FIG. 1.

FIG. 4 shows an example cladding board 900 for use with the cladding clip 100 of FIG. 1 or 2. The cladding board 900 comprises a tongue joint 901 at one end, and a complementary groove joint 903 at an opposite end. The board has a near side on a face facing the clip, and a far side on a face facing away from the clip. The board 900 further comprises a recess 905 spaced in from an end of the board on a near side of the board 900. In some examples the recess 905 comprises a rounded edge 907. As shown in FIG. 4, the cladding board 900 also comprises an optional secondary recess 913 spaced between the recess 905 and an end of the board 900.

The head 75 is configured to mate with the recess 905 in the cladding board 900, and the recess 905 is adapted for this purpose. The head 75 interacting with the recess 905 is adapted to locate the board at a selected position with respect to the flexible lip 50, so that a portion of the board 900 engages the flexible lip 50. In the examples shown in FIGS. 1, 2 and 3, the head 75 interacts with the recess 905 to hold the board 900 such that a portion of the groove joint 903 interacts with the flexible lip 50, as shown in FIG. 5*b*.

The flexible lip 50 is adapted to hold a cladding board 900. As shown in FIGS. 5*a* and 5*b*, the flexible lip 50 is configured to mate with a groove 903 and a tongue 901 of a tongue and groove joint of cladding boards 900 held by the clip 100. As shown in FIG. 5*a*, the flexible lip 50 is configured to mate with a tongue and groove joint by partially surrounding the tongue 901 of a tongue and groove joint of cladding boards 900 held by the clip 100.

Because the flexible lip 50 and the head 75 are formed from a resilient material they are resilient and capable of being deformed when a deforming force is applied, and returning to their original positions once the application of the deforming force is removed.

The lateral part 57 of the flexible lip 50 is configured to extend between the tongue 901 and groove 903 of the tongue and groove joint of cladding boards 900 held by the cladding clip 100. The flexible lip 50 is configured to hold a portion of a board 900 between a portion of the flexible lip 50 and the lateral base 10. As described above, in the example shown in FIG. 1 the lateral part 57 of the flexible lip 50 comprises a resilient belly and is configured to bias a portion of a board 900 toward the lateral base 10. In the example shown in FIG. 2, the lateral part 57 does not comprise a resilient belly and is not configured to bias a portion of a board 900 toward the lateral base 10. In the examples shown in FIGS. 1 and 2, the lateral part 57 of the flexible lip 50 is configured to grip a portion of a board 900 between the lateral part 57 and the lateral base 10 when the flexible lip 50 is deformed, for example when the hook of the second upstanding part 59 of the flexible lip 50 is engaged by a second board.

The cladding board 900 is adapted to fit the hooked portion of the second upstanding portion 59 of the flexible lip 50. For example, the tongue 901 of the cladding board 900 may comprise a bevelled edge 909 to mate with, for example to fit within, the second upstanding portion 59 of the flexible lip 50. The bevelled edge 909 has a shape complementary to that of the second upstanding portion 59 of the flexible lip 50 to inhibit movement of the tongue 901 vertically away from the clip 100. The tongue 901, and optionally the bevelled edge 909, are adapted to interact with the flexible lip 50 to hold the board 900 in place during assembly, for example on a ceiling, before all of the cladding boards 900 have been fixed in place.

To clad a surface such as a wall or ceiling with a plurality of cladding boards 900, a first portion of a first cladding board 900 is inserted into a flexible lip 50 of a cladding clip 100, for example so that the groove 903 presses against the second upstanding portion 59. Inserting the first portion of the cladding board 900 into the flexible lip 50 may act to deform the flexible lip 50, for example the belly of the lateral part 57 may be deformed upward, away from the lateral base 10 of the cladding clip 100. In examples where the flexible lip 50 is resilient, deformation of the flexible lip 50 acts to grip the cladding board 900 between the flexible lip 50 and the lateral base 10.

The board 900 is then pressed into the clip 100 towards the lateral base 10 so that the head 75 is received in the corresponding recess 905 in the near surface of the board 900. The spacing of the head 75 from the flexible lip 50 acts to retain the board 900 in the correct lateral position even when the board expands or contracts due to changes in ambient temperature or humidity. This is particularly noticeable when using natural wood cladding boards. Maintaining the correct position of the boards is important, both functionally and aesthetically, as if the position was not maintained the boards 900 may look wonky or uneven gaps may appear between them.

In general, in cladding a surface with a plurality of cladding boards 900, a plurality of cladding clips 100 are used. The cladding clips 100 are spaced at selected distances from each other. For example, the cladding clips are spaced apart from each other by a distance corresponding to a dimension of the cladding boards 900, for example by a distance that is the width of the cladding boards 900. As a first cladding board 900 is pressed into the clip 100 towards the lateral base 10, the tongue 901 of the first cladding clip 100 engages flexible lip 50 of a second clip 100 and may deform the flexible lip 50 of the second cladding clip 100. The bevelled edge 909 is received by the hooked portion of the second upstanding part 59 so that the board 900 is temporarily held in place by the first and second cladding clips 100. The lateral part 57 of the flexible lip 50 of the second cladding clip 100 may be configured to bias a portion of a second board 900 toward the lateral base 10 when the hooked portion of the second upstanding part 59 of the flexible lip 50 is engaged by the first board 900.

A first portion, for example a groove 903, of a second cladding board 900 is then inserted into the resilient lip 50 of the second cladding clip 100. In this way, the lateral part 57 of the flexible lip 50 of the second cladding clip 100 lines one surface of the groove 903 of the cladding board 900 and surrounds one surface of the tongue 901 of the cladding board 900, and the second upstanding part 59 lines another surface of the groove 903 and surrounds another surface of the tongue 901, so that the flexible lip 50 lines at least two surfaces of the groove 903 and surrounds at least two surfaces of the tongue 901. In this way, the flexible lip 50 at least partially lines the groove 903 and at least partially surrounds the tongue 901 of the tongue and groove joint of the cladding boards 900 held by the clip 100.

Although the example cladding clips 100 of FIGS. 1 and 2 are pressed from a sheet of resilient material, the clips 100 may be formed from other materials using other techniques, and the other materials may not be resilient. The clips 100 may be made from one sheet of material or a plurality of sheets of material. The material used to make the clips 100 may be resilient. In some examples, the parts of the flexible lip 50 are formed in ways other than bending or folding.

In some examples the flexible lip 50 is not resilient. In some examples, the flexible lip 50 is configured to bias the cladding board 900 towards the head 75 in a direction parallel to a surface the cladding clip 100 is attached to such that the corresponding recess 905 in the board 900 engages with the head 75 to hold the board 900 in place.

In some examples the clip 100 may not comprise a second upstanding part 59, and in other examples the second upstanding part 59 of the flexible lip 50 may be straight or take another shape. In some examples the hook in the second upstanding part 59 may be take another shape, for example the hook may comprise a first, straight portion, and a second, curved portion.

In some examples the head 75 may be resilient to accommodate movement of a cladding board 900, for example due to thermal expansion. For example, the head 75 may be compressible so that if thermal expansion or contraction of the cladding board 900 causes the recess 905 to squeeze the head 75, the head 75 can deform to accommodate the squeezing. In some examples, the head 75 may be able to bend or flex laterally, so that if one side of the cladding board 900 expands or contracts more than the other side, for example in a lateral direction, the head 75 can bend or flex laterally to accommodate this expansion or contraction.

In some examples the head does not comprise a resilient loop 77 or a resilient neck 79. In examples where the head 75 comprises a resilient loop 77 and a neck 79, the resilient loop 77 and neck 79 are configured to bend and/or flex to absorb movement of the cladding board 900. In some examples the resilient loop 77 may form a complete circle, for example the resilient loop 77 may be connected at both ends to a resilient neck 79. In some examples, only parts of the head 75 may be resilient, for example the neck 79 may be resilient but the loop 88 is not resilient, or vice-versa.

In some examples, as shown in FIG. 1, the flexible lip 50 comprises a second lateral part 61 coupling the first upstanding part 55 to the lateral base 10. The second lateral part 61 lies laterally, abutting the lateral base 10. In some examples the second lateral part 61 is formed from a fold in the lateral base 10. As shown in FIGS. 1 and 2, the second lateral part 61 may comprise a hole 63 therethrough, for example through a centreline of the lateral base 10. The diameter of the hole as shown in FIG. 2 is 5 mm, although other dimensions may be suitable. The hole 63 may be adapted to receive a fastening means, for example a bolt or a rivet (for example a friction rivet), for fastening the clip 100 to a surface.

In examples where the flexible lip 50 comprises a second lateral part 61, the second lateral part 61 is configured to provide a spring to allow resilient movement of the flexible lip 50 away from the lateral base 10. The second lateral part 61 may act to bias a portion of a cladding board 900, for example a groove 901, toward the lateral base 10.

In some examples the clips 100 comprise an optional locator tab 65, shown in FIGS. 1 and 2. The locator tab 65 may be upstanding from the lateral base 10 but on an opposing side of the lateral base 10 to the flexible lip 50 and head 75. The locator tab 65 may be located along the centreline of the lateral base 10, for example in line with the hole 63. The locator tab 65 is configured to engage a corresponding cavity in a surface to which the clip 100 is coupled to inhibit lateral movement of the clip 100.

In some examples the cladding board 900 comprises a rounded edge 907 to recess 905. The rounded edge 907 may act to improve location of the head 75 within the recess 905. Similarly, the groove 903 may comprise a rounded edge 911. The rounded edge 911 of the groove 903 may be adapted to mirror the shape of the bevelled edge 909 of the tongue 901 and/or the shape of the hooked portion of the second upstanding part 59 of the flexible lip 50. The rounded edge 911 may be adapted to improve the fit between the board 900 and the clip 100 and with adjacent boards 900. In some examples the cladding board 900 is not adapted to fit to the shape of the hooked portion of the second upstanding portion 59 of the flexible lip 50. In some examples, the cladding board 900 does not comprise a bevelled edge 909.

The cladding board 900 may also comprise a secondary recess 913 spaced between the recess 905 and an end of the board 900. The secondary recess 913 may be shaped to fit the shape of a fastening means, for example a fastening means passing through hole 63 fastening the clip 100 to a surface. For example, the secondary recess 913 may be shaped to receive a bolt head, a screw head or a rivet head.

FIG. 6 shows a plan view of two battens 600*a*, 600*b* used to support the cladding clips 100 of FIGS. 1 and 2. The battens 600 may be used as a support for the cladding clips 100, and may space the cladding clips 100 from the surface, for example to provide a floating wall. The battens 600 may be hollow to reduce weight and cost. In the examples of FIGS. 6*a* and 6*b*, the battens 600 are made from aluminium and are U-shaped, so as to provide a flat surface for the cladding clips 100 to fasten to, with two walls extending towards the surface for fixing the battens. Each wall may comprise a fastening means for fastening the batten 600 to the surface, or to another structure to support the batten 600.

The two battens 600*a*, 600*b* are connected together via a mating portion 601, 603. Each batten 600*a*, 600*b* carries a respective clip 100 spaced at a selected interval, although in some examples each batten 600*a*, 600*b* may carry a plurality of cladding clips 100, with each cladding clip spaced at a selected interval. The selected interval may be selected so that the spacing between adjacent cladding clips 100, in use, corresponds to a dimension of the cladding boards 900, for example the width of the cladding boards 900.

Each batten 600*a*, 600*b* may comprise a fixing means for fixing a clip 100 to the batten 600*a*, 600*b*, for example a threaded bolt or a threaded hole for a threaded screw, or rivets. Each batten 600*a*, 600*b* may also comprise a cavity for receiving the optional locator tab 65. The cavity may be spaced at a selected position on the batten 600*a*, 600*b* and may be used to locate a cladding clip 100 in the correct location on a batten 600*a*, 600*b* so that cladding clips 100 on adjacent battens 600*a*, 600*b* are spaced at the selected interval. In some examples, the cavity may be a hole in the batten 600*a*, 600*b*.

The mating portion 601, 603 shown in FIG. 6 comprises a female portion 601 and a male portion 603, and in the example shown forms a dovetail joint although other locking joints may be suitable, for example other mortise and tenon joints such as a hammerhead tenon joint. The mating portion 601, 603 is configured to inhibit separation of one batten 600*a* from another batten 600*b* when two battens 600*a*, 600*b* are mated via the mating portion. For example, the mating portion 601, 603 locks the position of one batten 600*a* with respect to the other 600*b*. By locking the position of the two battens 600*a*, 600*b* in this way, the spacing between cladding clips 100 on adjacent mated battens 600*a*, 600*b* is within a selected range, for example within a tolerance of less than 10 mm, less than 5 mm, less than 1 mm, less than 0.5 mm.

In use, a series of battens 600 may be fixed to a surface, such as a wall or ceiling, for example in a row. To fix cladding boards 900 to a surface, a plurality of rows of battens 600 may be used. To start a row of battens 600, a first batten 600*a* is fixed to the surface, for example using fixing means, such as adhesive, screws or nails. The position of the first batten 600*a* may be selected to line up with another surface, or the end of the surface, for example so that the first batten 600*a* is fixed to a wall parallel to the floor or ceiling. Once the first batten 600*a* is fixed to the surface, a second batten 600*b* may be coupled to the first batten 600*a* via the mating portion 601, 603. The second batten 600*b* may comprise a male mating portion 603 at one end, and a female mating portion 601 at the other end. The first batten 600*a* may comprise a female mating portion 601 at one end, and a male mating portion 603 at the other end. In some examples, the first batten 600*a* (or last batten 600, i.e. a batten 600 forming the end of a series or row of battens) may only comprise one mating portion 601, 603.

To couple the second batten 600*b* to the first batten 600*a*, as shown in FIG. 6, the male mating portion 603 of the second batten 600*b* may be inserted into the female mating portion 601 of the first batten 600*a*. Insertion may be done by pushing the second batten 600*b* down towards the surface the first batten 600*a* is fixed to so that the male mating portion 603 slides into the female mating portion 601 in a direction towards the surface. Once slid into place, the mating portions 601, 603 lock the position of the battens 600*a*, 600*b* into place, and the second batten 600*b* may be fixed to the surface in the same way as the first batten 600*a*. Once the second batten 600*b* is fixed into position, a third, fourth and so on, battens 600 may be fixed to the surface until the battens 600 extend in a row to cover the desired surface. The cladding clips 100 on each batten 600 of a row may all be orientated in the same direction.

A second row of battens 600 may be fixed to the surface in a manner similar to that of the first row of battens 600. When fixing the second row of battens 600 to the surface, the first batten 600 of the second row may be positioned to lie parallel to and/or in alignment with the first batten 600 of the first row. For example, a fixture on the first batten 600 of the second row may be aligned with a fixture on the first batten 600 of the second row. The alignment may be perpendicular to the rows of battens 600, or may be at an angle to the rows of battens 600, for example at 45 degrees to the rows of battens 600. The battens 600 may be aligned using a plumb line, a spirit level or a laser line, for example.

The cladding clips 100 may already be fixed to the battens 600 before the battens 600 are fixed to the surface, or the cladding clips 100 may be fixed to the battens 600 after the battens 600 have been fixed to the surface. If the cladding clips 100 are fixed to the battens 600 after the battens 600 have been fixed to the surface, if the battens 600 are aligned and each batten 600 comprises a fixing means for a respective cladding clip 100, then when the cladding clips 100 are fixed to the battens 600, the cladding clips 100 will also be aligned. If the cladding clips 100 are already fixed to the battens 600 before the battens 600 are fixed to the surface, then when the battens 600 are aligned and fixed in place, the cladding clips 100 will also be aligned.

If the cladding clips 100 are aligned, then cladding boards can be fixed to the surface by fixing each cladding board 900 to more than one cladding clip 100 from more than one row of battens 600, for example so that each cladding board 900 bridges two or more rows of battens 600.

FIG. 7 shows an adjustable offset member 500 for use with the battens 600 and cladding clip 100 of FIGS. 1 to 6. The adjustable offset member 500 comprises a base 501 and a grip 503 for holding the batten 600. The adjustable offset member 500 may hold a batten 600 in a mating arrangement with another batten 600. The base 501 is adapted to be coupled to a surface 700, such as a wall. The grip 503 is adapted to couple to a batten 600. However, in some examples the grip 503 may comprise the batten 600.

In the example shown, the base 501 and grip 503 are adapted to slide with respect to each other in a direction towards and away from the wall 700 (e.g. normal to the wall), and a fastening means 505 is adapted to fix the location of the grip 503 with respect to the base 501. In this way, the degree of overlap between the grip 503 and the base 501 can be adjusted so that the spacing distance of the grip 503 from the wall can be adjusted. For example, the grip 503 may comprise a hole or slot so that the position of the grip 503 can be adjusted with respect to the base 501. Additionally or alternatively, the base 501 may also comprise a hole or slot so that the position of the grip 503 can be adjusted with respect to the base 501.

In the example shown in FIG. 7, the base 501 comprises a U-shaped male portion, and the grip 503 comprises a corresponding U-shaped female portion, for example a U-shaped batten 600. The U-shaped male portion of the base 501 is received by the U-shaped female portion of the grip 503, so that the grip 503 can slide with respect to the base 501. In the example shown in FIG. 7 the grip 503 can slide over the base 501.

In other examples the base 501 may comprise a male portion having a different shape and likewise the grip 503 may comprise a female portion having a different shape. In some examples the base 501 and grip 503 comprise neither male nor female portions, so long as one of the base 501 and/or grip 503 are adapted to move with respect to, and couple to, the other.

The position of the grip 503 with respect to the base 501 may be adjustable by a user so that the spacing distance of the grip 503 from the base 501 can be adjusted to accommodate irregularities in the surface of the wall 700. As mentioned above, the adjustable offset member 500 may comprise a fastening means 505 to couple the grip 503 to the base 501 at the desired spacing distance. The fastening means 505 may be provided by a screw and wing nut, or in other examples by a nut and bolt. In some examples the fastening means 505 comprises a clamp, for example a band clamp, a G-clamp, a screw clamp or a toggle clamp. In other examples the fastening means 505 comprises a spring-loaded pin and a corresponding series of holes for receiving the spring-loaded pin. In other examples, however, the adjustable offset member 500 does not comprise a fastening means 505. For example, the base 501 and grip 503 may have an interference fit to fix the location of the grip 503 with respect to the base 501.

The fastening means 505 may be fixed to one of the base 501 or the grip 503, or to both. For example, the fastening means 505 may be fixed to the base 501 and be adapted to secure the grip 503 at a selected position with respect to the base 501. Additionally or alternatively, the fastening means 505 may be fixed to the grip 503 and be adapted to secure the grip 503 at a selected position with respect to the base 501. For example, the fastening means 505 may be configured to slide within a slot in the grip 503 or base 501 so that the selected position can be selected sliding the grip 503 with respect to the base 501, and once in the selected position, the fastening means 505 can be tightened to secure the grip 503 in place with respect to the base 501. The selected position may be selected to be the desired spacing distance.

The base 501 may also comprise a portion that is wider than the U-shaped portion, for example the base 501 may comprise two arms or a base plate for fixing the base 501 to the wall 700. The two arms or base plate may comprise a fixture for fixing the base 501 to the wall 700, for example a hole for a fastening means such as a screw or rivet.

As described above, the grip 503 may comprise a batten 600. In other examples, the grip 503 may be adapted to couple to a batten 600, for example the grip 503 may comprise a fixture for coupling the grip 503 to a batten 600. Similarly, in some examples a batten 600 may comprise a fixture for coupling to the grip 503. For example, each batten 600 may have a fixture for coupling to the grip 503. The fixture may be spaced at a selected interval on the batten 600, for example so that if a series of adjustable offset members 500 are fixed to a wall at a selected interval, the battens are equally spaced by the selected interval. For example, the selected interval may be selected to be the midpoint of each batten 600.

The adjustable offset member 500 of FIG. 7 may be used with the series of battens 600 described above in relation to FIG. 6 to form rows of battens 600. For example, before fixing a series of battens 600 to a surface, such as a wall 700, a series of adjustable offset members 500 may be fixed to the surface at selected intervals, for example where the selected intervals are chosen to be the length of each of the battens 600. In some examples, the fixing each of the battens 600 to a surface such as the wall 700 comprises fixing the adjustable offset member 500 to the wall 700, for example when the grip 503 comprises the batten 600.

Fixing the battens 600 to a surface, such as a wall 700, may comprise fixing the base 501 to the surface, for example using a fastening means. Once the base 501 is fixed to the surface, the grip 503 may be manoeuvred into position so that it fits on or within the base 501 and is slidable with respect to the base 501. The position of the grip 503 from the surface can then be adjusted by sliding the grip 503 with respect to the base 501 until it is in the desired position at the desired spacing distance. The desired spacing distance may be determined to accommodate uneven surfaces, for example due to a hollow in a wall. Once at the desired spacing distance, the fastening means 505 may be tightened to couple the grip 503 to the base 501. If the grip 503 does not already comprise the batten 600, the batten 600 may then be coupled to the grip 503. An adjustable offset member 500 may be used for each batten 600 of a series of battens 600. Adjustable offset members 500 may be aligned in a way similar to that described above for aligning battens 600, so that when fixed to a surface such as a wall, rows of battens 600 are aligned. In some examples, instead of aligning the battens 600 themselves to obtain aligned rows of battens 600, the adjustable offset members 500 may each be aligned before fixing battens 600 to the adjustable offset members 500. In these examples, this may make cladding an irregular surface more efficient because only the adjustable offset members 500 need to be aligned for rows of battens 600 to be aligned.

Fixing a series of battens 600 to a surface may comprise fixing the base 501 of a series of adjustable offset members 500 to the surface, adjusting the spacing distance of the grip 503 of each of the adjustable offset members 500 from the surface so that the grip 503 of each adjustable offset member 500 is aligned, and then coupling the grip 503 to the base 501 using the fastening means 505 so that the spacing distance is fixed. For example, the spacing distance of each adjustable offset member 505 may be selected so that the grips 503 of each adjustable offset member 500 provide a flat or level surface for battens 600 and/or cladding clips 100. In this way, a flat surface of cladding boards 900 can be fixed to an irregular or uneven surface.

For example, fixing a series of adjustable offset members 500 to a surface may comprise fixing a first adjustable offset member 500 to the surface at a first position with a first spacing distance from the surface, fixing a second adjustable offset member 500 to the surface at a second position at a selected interval from the second adjustable offset member and at a second spacing distance from the surface and adjusting the second spacing distance of the second adjustable offset member 500 so that both adjustable offset members 500 provide a flat surface, for example a level surface, for cladding boards 900 to be fixed to. The method may further comprise fixing a third adjustable offset member 500 to the surface at a third position at the selected interval from the second adjustable offset member at a third spacing distance from the surface, and adjusting the third spacing distance so that the first, second and third adjustable offset members 500 provide a flat surface, for example a level surface, for cladding boards 900 to be fixed to. The spacing distances may be adjusted using a spirit level, a plumb line or a laser line to provide the flat surface.

The cladding clips 100 may be provided as part of a kit. For example, the kit may comprise a plurality of cladding clips 100 having a flexible lip 50 and a head 75 upstanding from a lateral base 10 and a plurality of cladding boards 900, wherein each cladding board 900 comprises a projection adapted to mate with the flexible lip 50, a first recess 905 adapted to mate with the head 75 and a second recess 903 adapted to mate with both the projection of another similar cladding board and with a flexible lip of a second cladding clip. The cladding boards 900 may be the cladding boards 900 shown in FIG. 4, and the cladding clips may be the cladding clips 100 shown in FIGS. 1 and 2, as described above. The projection and recess of each cladding board may be a tongue and groove of a tongue and groove joint, for example tongue 901 and groove 903 shown in FIGS. 4, 5*a* and 5*b*.

The battens 600 described above may be used in a method of cladding a structure. For example, the method may comprise fixing a first batten 600 of a first series of battens 600 to a structure and aligning a second batten 600 of a second series of battens 600 with a reference mark on the first batten of the first series of battens. The second batten 600 of the second series of battens 600 may be aligned with the first batten 600 of the first series when all of the first series of battens 600 have been fixed to the structure, or when only the first batten 600 of the first series of battens 600 has been fixed to the structure.

The second series of battens 600 may then be fixed to the structure parallel to the first batten 600. If the remaining battens 600 of the first series of battens 600 have not been fixed to the structure they may also be fixed.

Each batten 600 of the first and second series of battens 600 may have a fixture for carrying a cladding clip 100 on a cladding surface and a mating portion for mating with a respective mating portion of another batten of the series so that, when fixed to the structure, each of the fixtures of the first series of battens 600 is aligned with a corresponding fixture of the second series of battens 600.

To align the second batten 600 of the second series of battens 600 with a reference mark on the first batten 600 of the first series of battens 600, a plumb line, a laser line or a spirit level, for example, may be used. The battens 600 may be aligned vertically, horizontally or at an angle, for example at 45 degrees to a floor or ceiling.

Other variations and modifications of the cladding clips, battens and apparatus described herein will be apparent to persons of skill in the art in the context of the present disclosure.

The invention claimed is:

1. A cladding clip comprising:

a lateral base;

a head coupled to and upstanding from the lateral base; and a flexible lip configured to hold a first cladding board, wherein the flexible lip is upstanding from the lateral base and laterally spaced from the head along the lateral base;

wherein an upstanding part of the flexible lip is hooked so that a lateral part of the flexible lip extends laterally, spaced from the lateral base;

wherein the flexible lip is configured to mate with a tongue and groove joint by partially surrounding a tongue of the tongue and groove joint of at least the first cladding board held by the cladding clip;

wherein the upstanding part of the flexible lip is a second upstanding part, and the flexible lip further comprises a first upstanding part which spaces the lateral part of the flexible lip from the lateral base and the second upstanding part upstanding from the lateral part of the flexible lip; and wherein the lateral part of the flexible lip is configured to bias a portion of the first cladding board toward the lateral base when the second upstanding part of the flexible lip is engaged by a second cladding board.

2. The cladding clip of claim 1, wherein the flexible lip comprises a second lateral part, the second lateral part coupling the first upstanding part to the lateral base, optionally wherein the second lateral part lies laterally, abutting the lateral base, optionally wherein the second lateral part is configured to provide a spring to allow resilient movement of the flexible lip away from the lateral base.

3. The cladding clip of claim 1, wherein the head comprises a resilient loop coupled to the lateral base by a resilient neck upstanding from the lateral base.

4. The cladding clip of claim 1, further comprising a locator tab that extends out from the lateral base on an opposite side to the head, wherein the locator tab is configured to engage a corresponding cavity in a surface to which the cladding clip is coupled to inhibit lateral movement of the cladding clip.

5. The cladding clip of claim 1, wherein the flexible lip is configured to hold a portion of the cladding board between a portion of the flexible lip and the lateral base, optionally wherein deformation of the flexible lip grips the cladding board between the flexible lip and the lateral base, optionally wherein the flexible lip is configured to bias a portion of the cladding board toward the lateral base.

6. The cladding clip of claim 1, wherein the lateral part of the flexible lip comprises a resilient belly configured to bias a portion of the cladding board toward the lateral base.

7. The cladding clip of claim 1, wherein the cladding board comprises a projection at one end adapted to mate with the cladding clip, a first recess on a near side adapted to mate with the cladding clip, and a second recess at an end opposite to that of the projection, wherein the second recess is adapted to mate with both the projection of a second cladding board and a second cladding clip.

8. The cladding clip of claim 1, wherein the head is configured to mate with a corresponding recess in the cladding board to locate the cladding board at a selected position with respect to the flexible lip.

9. The cladding clip of claim 8, wherein the flexible lip is configured to bias the cladding board towards the head in a direction parallel to a surface the cladding clip is attached to such that the corresponding recess in the cladding board engages with the head to hold the cladding board in place.

10. The cladding clip of claim 1, wherein the flexible lip is configured to mate with at least one of a groove and a tongue of a tongue and groove joint of cladding boards held by the cladding clip.

11. The cladding clip of claim 8, wherein, in use, the flexible lip at least partially lines the groove and at least partially surrounds the tongue of a tongue and groove joint of cladding boards held by the cladding clip, optionally wherein the lateral part of the flexible lip is configured to extend between a tongue and groove of a tongue and groove joint of cladding boards held by the cladding clip.

12. The cladding clip of claim 1, wherein the cladding clip is incorporated into a batten carrying the cladding clip, the batten having a mating portion adapted to couple with a complementary mating portion of another corresponding batten to lock a position of the batten with respect to the other batten so that a spacing between cladding clips on adjacent mated battens is within a selected range.

13. The cladding clip of claim 12, wherein the cladding clip is incorporated into a cladding system comprising the batten and an adjustable offset member for holding the batten a spacing distance away from a surface that the cladding board is to be fixed to, wherein the adjustable offset member has a base and a grip, wherein a position of the grip with respect to the base is adjustable by a user so that the spacing distance of the grip from the base is adjustable to accommodate irregularities in the surface; and the adjustable offset member further includes a fastening means for coupling the grip to the base at a desired spacing distance; optionally wherein the base is adapted to fit within the grip, optionally wherein the grip is slidable with respect to the base to adjust the spacing distance.

14. The cladding clip of claim 1, wherein the second upstanding part is curvilinear.

15. The cladding clip of claim 14, wherein the second upstanding part is S-shaped.

16. The cladding clip of claim 15, wherein the head comprises a resilient loop coupled to the lateral base by a resilient neck upstanding from the lateral base.

17. The cladding clip of claim 16, wherein the cladding clip extends laterally between a first end and a second end, the head is located at the first end, the second upstanding part is located at the second end, and the lateral part extends laterally away from the lateral base toward the second end.

18. The cladding clip of claim 16, wherein the cladding clip extends laterally between a first end and a second end, the head is located at the first end, and the first upstanding part is spaced apart laterally from the second end.

19. The cladding clip of claim 18, further comprising a locator tab that extends out from the lateral base on an opposite side to the head, wherein the locator tab is configured to engage a corresponding cavity in a surface to which the cladding clip is coupled to inhibit lateral movement of the cladding clip.

* * * * *